US008122673B2

(12) United States Patent
Ellis et al.

(10) Patent No.: US 8,122,673 B2
(45) Date of Patent: Feb. 28, 2012

(54) PORTABLE SAFETY SKYLIGHT REPLACEMENT ASSEMBLY

(76) Inventors: J. Nigel Ellis, Wilmington, DE (US); John Whitty, Richmond, VA (US)

( * ) Notice: Subject to any disclaimer, the term of this patent is extended or adjusted under 35 U.S.C. 154(b) by 148 days.

(21) Appl. No.: 12/259,020

(22) Filed: Oct. 27, 2008

(65) Prior Publication Data

US 2009/0107060 A1 Apr. 30, 2009

Related U.S. Application Data

(60) Provisional application No. 60/983,163, filed on Oct. 27, 2007.

(51) Int. Cl.
*E04G 21/32* (2006.01)
*E04D 13/03* (2006.01)

(52) U.S. Cl. ..... 52/664; 52/645; 52/660; 52/DIG. 12; 5/625

(58) Field of Classification Search ..... 52/79.9, 52/645, 664, DIG. 12, 200, 202, 633, 656.1, 52/660; 248/188.9; 49/504; 403/339; 5/625, 626, 627
See application file for complete search history.

(56) References Cited

U.S. PATENT DOCUMENTS 338,349 A * 3/1886 Johnstone ..... 5/627
(Continued)

FOREIGN PATENT DOCUMENTS

EP 400760 A1 * 12/1990
(Continued)

*Primary Examiner* — Brian Glessner
*Assistant Examiner* — Joseph J Sadlon
(74) *Attorney, Agent, or Firm* — Sherr & Vaughn, PLLC

(57) ABSTRACT

A portable skylight replacement safety assembly that includes a first and second support frames releasably connected to each other and having a plurality of support handles and support members which extend substantially perpendicularly from the first support frame for supporting the first support frame on and/or over the skylight on a working surface at a predetermined distance.

13 Claims, 5 Drawing Sheets

Figure 1:
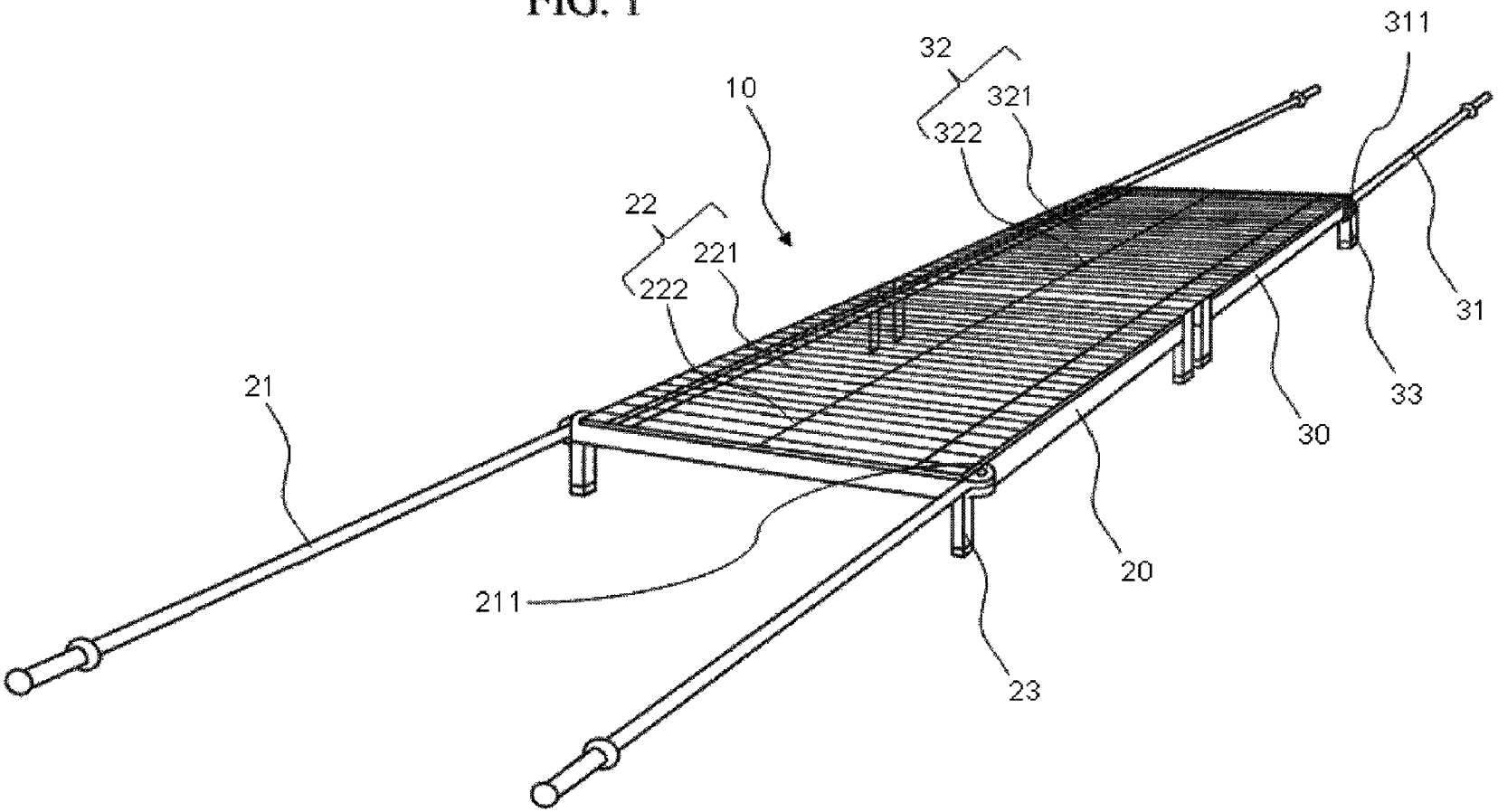

U.S. PATENT DOCUMENTS 542,374 A * 7/1895 Sauerbier et al. ..... 5/111
765,369 A * 7/1904 Smith et al. ..... 5/627
917,859 A * 4/1909 Fusch ..... 52/489.1
1,016,856 A * 2/1912 Schroeder ..... 52/200
1,842,621 A * 1/1932 Meyer ..... 404/17
2,299,993 A * 10/1942 Kirk ..... 280/20
2,503,314 A * 4/1950 Atwood ..... 5/627
3,173,226 A * 3/1965 Solnick ..... 52/89
3,203,150 A * 8/1965 Serneblad ..... 52/664
3,255,115 A * 6/1966 Peterson ..... 482/148
3,313,081 A * 4/1967 Squire ..... 52/645
3,408,664 A * 11/1968 Jarman ..... 5/627
3,438,099 A * 4/1969 Green ..... 24/704.1
3,592,289 A * 7/1971 Aysta et al. ..... 160/135
3,885,675 A * 5/1975 Hultenby et al. ..... 211/118
4,575,965 A * 3/1986 Iversen ..... 49/50
4,685,161 A * 8/1987 Zalman ..... 5/627
4,807,317 A * 2/1989 Quinn et al. ..... 14/69.5
4,811,530 A * 3/1989 Eyerly ..... 52/6
4,943,534 A * 7/1990 Andreasen ..... 435/291.2
4,947,418 A * 8/1990 Barr et al. ..... 378/177
D354,817 S * 1/1995 Kovacs et al. ..... D25/53
5,477,654 A * 12/1995 Weelink ..... 52/664
5,502,934 A * 4/1996 Coyne et al. ..... 52/200
5,598,668 A * 2/1997 Isom ..... 52/86
5,697,669 A * 12/1997 Yemini ..... 297/188.1
5,738,160 A * 4/1998 Rice ..... 160/84.06
5,795,267 A * 8/1998 Weaver ..... 482/35
5,970,531 A * 10/1999 Demby ..... 4/498
5,984,837 A * 11/1999 Weaver et al. ..... 482/35
6,050,015 A * 4/2000 Lurie ..... 40/783
6,199,330 B1 * 3/2001 Cobb ..... 52/202
6,209,271 B1 * 4/2001 Kovacs ..... 52/200
6,272,800 B1 * 8/2001 Phinney et al. ..... 52/200
6,390,725 B1 * 5/2002 Masters ..... 403/403
6,477,972 B2 * 11/2002 Perkins ..... 114/201 R
6,668,402 B2 * 12/2003 Heimbrock ..... 5/600
6,842,923 B1 * 1/2005 Castellani et al. ..... 5/627
7,073,216 B2 * 7/2006 Schwingeler et al. ..... 5/118
7,287,732 B2 * 10/2007 Balistreri ..... 248/188.4
7,300,037 B2 * 11/2007 Beirne et al. ..... 256/64
7,395,636 B2 * 7/2008 Blomberg ..... 52/200
7,516,575 B2 * 4/2009 Cuccurullo ..... 52/20
7,607,186 B1 * 10/2009 Mitchell ..... 14/69.5
2001/0045555 A1 * 11/2001 Ross ..... 256/65
2004/0050010 A1 * 3/2004 Fortier ..... 52/650.3
2004/0133998 A1 * 7/2004 Sloniker et al. ..... 14/69.5
2006/0162272 A1 * 7/2006 Phillips et al. ..... 52/660

FOREIGN PATENT DOCUMENTS

FR 2610974 A1 * 8/1988
FR 2705985 A1 * 12/1994
GB 2155980 A * 10/1985
GB 2199599 A * 7/1988
WO WO 8700570 A1 * 1/1987

* cited by examiner

PORTABLE SAFETY SKYLIGHT REPLACEMENT ASSEMBLY

The present application claims priority to U.S. Provisional Patent Application No. 60/983,163 (filed on Oct. 27, 2007), which is hereby incorporated by reference in its entirety.

BACKGROUND

Skylights are often used in order to permit natural sunlight to enter into an interior space of a residential home, building, church and the like. Due to the relative spatial location of skylights and other roof openings, they create an occupational hazard. Fatalities serious injuries related to falls through skylights and/or protective screening for skylights. For instance, impact falls have occurred from workers falling through unguarded skylight openings. Such falls have also occurred when conducting routine roof and/or skylight maintenance and replacing and/or providing protective screening for skylights.

Occupational Safety and Health Administration (OSHA) standard 29 CFR §1926.500(b)(4) requires that skylights be protected with railings and covers to protect against falls through a skylight/vent and/or a skylight/vent opening. In accordance with OSHA standard 29 CFR §1926.500(b)(4), if there is a danger of falling through a skylight, the skylight must be guarded with a standing railing or a cover strong enough to sustain the impact load of a person. In an attempt to meet the need to become OSHA compliant, various designs such as protective screens and railings have been employed. These devices, however, have proven inadequate or otherwise disadvantageous due to manufacturing costs and/or the lack of a robust structural design, and/or, the complexity of assembly/disassembly, and/or the lack of portability, and/or the lack of adequate space to permit maintenance be done to replace or install a skylight.

SUMMARY

Embodiments relates to a portable skylight safety assembly which facilitates the replacement and/or installation of skylights, vents and the like and the addition of protective screening for skylights that are typically installed on flat roofs such as corrugated roofs of buildings, homes, churches and the like.

Embodiments relates to a portable safety assembly to provide protection against falls over skylights, skylight openings, floor openings, vent openings and other types of roof openings. The portable safety assembly is adaptable for all structural skylight models, such as flat, domed, circular, etc.

Embodiments relate to a portable skylight safety assembly that may include at least one of the following: a first support frame including a first support array having a plurality of parallel-spaced transverse members and a plurality of parallel-spaced longitudinal frame members, a plurality of first support handles, a plurality of support members extending substantially perpendicularly from the first support frame for supporting the first support frame over the skylight on a working surface, and a first releasable attachment mechanism provided on a distal one of the plurality of parallel-spaced transverse members; a second support frame including a second support array having a plurality of parallel-spaced transverse members and a plurality of parallel-spaced longitudinal frame members, and a second releasable attachment mechanism provided on a distal end of the second support frame for receiving the first releasable attachment mechanism to provide a releasable attachment or connection between the first support frame and the second support frame.

Embodiments relate to a portable skylight safety assembly that may include at least one of the following: a first support frame including a first support array having a plurality of parallel-spaced transverse members, a pair of parallel-spaced outer longitudinal frame members and an inner longitudinal frame member spaced in parallel from the outer longitudinal frame members; a first releasable attachment mechanism provided on the first support frame; a second support frame including a second support array having a plurality of parallel-spaced transverse members, a pair of parallel-spaced outer longitudinal frame members and an inner longitudinal frame member spaced in parallel from the outer longitudinal frame members; a second releasable attachment mechanism provided on the second support frame for receiving the first releasable attachment mechanism to provide a releasable attachment between the first support frame and the second support frame; a plurality of support handles extending from the first support frame and the second support frame; and a plurality of support members extending substantially perpendicularly from the first support frame and the second support frame for supporting the first support frame and the second support frame over the skylight on a working surface.

Embodiments relate to a portable skylight safety assembly that may include at least one of the following: a first support frame including a plurality of parallel-spaced transverse members, a pair of parallel-spaced outer longitudinal frame members and an inner longitudinal frame member spaced in parallel from the outer longitudinal frame members; a second support frame including a plurality of parallel-spaced transverse members, a pair of parallel-spaced outer longitudinal frame members and an inner longitudinal frame member provided between the outer longitudinal frame members; a releasable attachment mechanism for releaseably attaching the first support frame to the second support frame; and a plurality of support members for supporting the first support frame and the second support frame predetermined vertical distance above the skylight on a working surface.

In accordance with embodiments, the transverse members, the longitudinal members and the releasable attachment mechanism may be composed of at least one of a lightweight metal-based material, a lightweight composite material or a lightweight polymeric material. The metal-based material may be composed of aluminum. The lightweight nature facilitates the portability of the assembly by two persons. Once the two support frames are manipulated into an operating position, one may perform routine maintenance on a skylight, replacement of a skylight, routine roof repair and/or provide a protective screen over the skylights. The handles may be pivotable between a working position and a non-working position. The support members may displace the support frames (at a bottommost surface) thereof to a predetermined distance above a working surface in order to permit access to a skylight/vent in order to perform maintenance and/or replacement. This predetermined distance may be at least six inches.

Embodiments relate to an assembly that may include at least one of the following: a first support frame having fore and aft first support members spaced apart and extending substantially perpendicularly from the first support frame for supporting the first support frame on a working surface; a second support frame releasably connected to the first support frame and having fore and aft second support members spaced apart and extending substantially perpendicularly from the second support frame for supporting the first support frame on a working surface; and a plurality of support handles provided on the first and second support frames, wherein the support handles are pivotably moveable with respect to a respective one of the first and second support frames between a non-operating position and an operating position.

Embodiments relate to a portable skylight safety assembly that may include at least one of the following: a first support frame including a first support array having a plurality of parallel-spaced transverse members, a pair of parallel-spaced outer longitudinal frame members and an inner longitudinal frame member spaced in parallel from the outer longitudinal frame members; a first releasable attachment mechanism provided on the first support frame, wherein the first releasable attachment mechanism includes a hook member; a second support frame including a second support array having a plurality of parallel-spaced transverse members, a pair of parallel-spaced outer longitudinal frame members and an inner longitudinal frame member spaced in parallel from the outer longitudinal frame members; a second releasable attachment mechanism provided on the second support frame, wherein the second releasable attachment mechanism includes a bar that receives and engages the hook member of the first releasable attachment mechanism to releasable connect the first support frame to the second support frame; a plurality of pivotably moveable support handles provided on the first support frame and the second support frame; and a plurality of support members extending substantially perpendicularly from the first support frame and the second support frame for supporting the first support frame and the second support frame on a working surface.

Embodiments relate to a portable skylight safety assembly that may include at least one of the following: a first support frame including a mesh surface; a second support frame including a mesh surface; a plurality of support members for supporting the first support frame and the second support frame a predetermined vertical distance above a working surface; and a plurality of pivotably moveable support handles provided on the first support frame and the second support frame such that the support handles are pivotably moveable with respect to a respective one of the first and second support frames between a non-operating position on sidewalls of the first and second support frames and an operating position extending outwardly from a respective sidewall and in the same plane as the respective sidewall.

DRAWINGS

Example FIGS. 1-5 illustrate a portable skylight safety assembly in accordance with embodiments.

DESCRIPTION

Figures 2A, 2B:
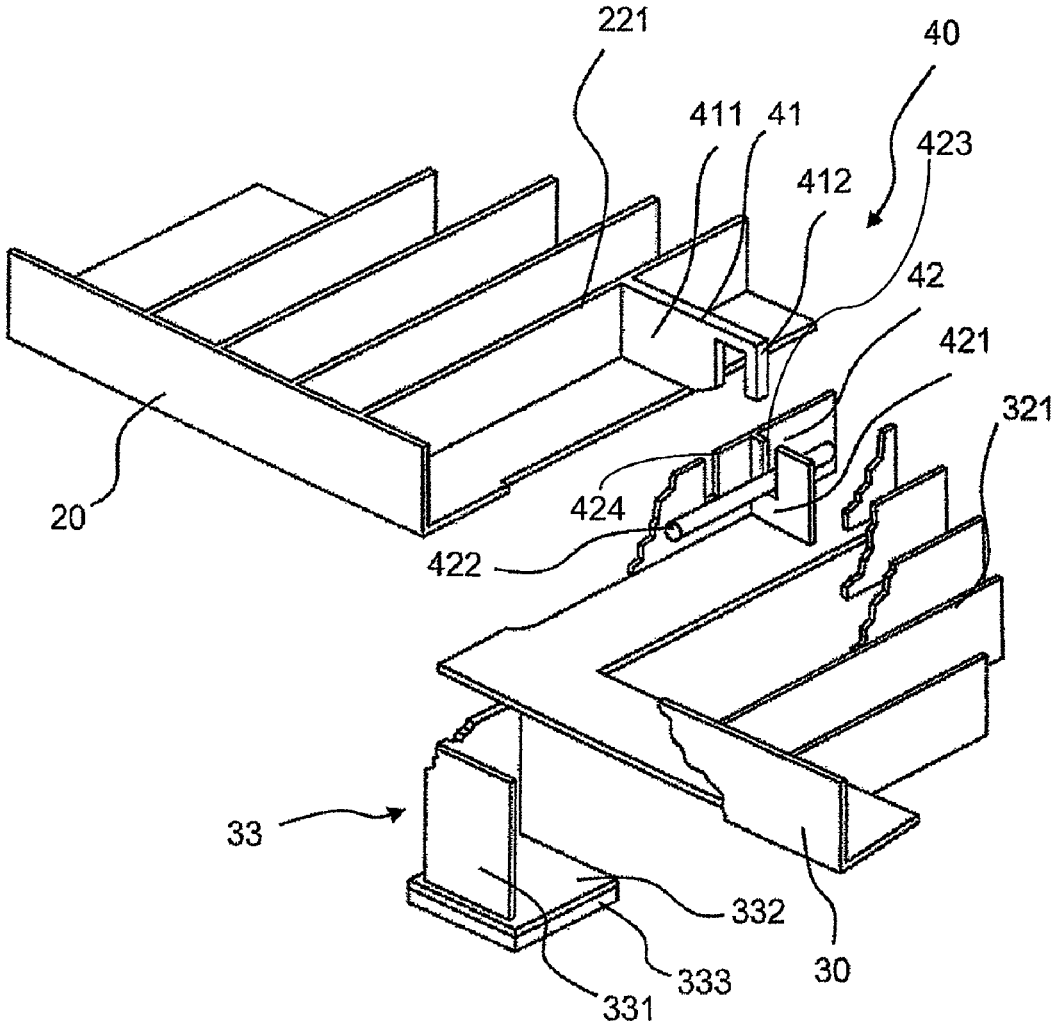
Figure 3:
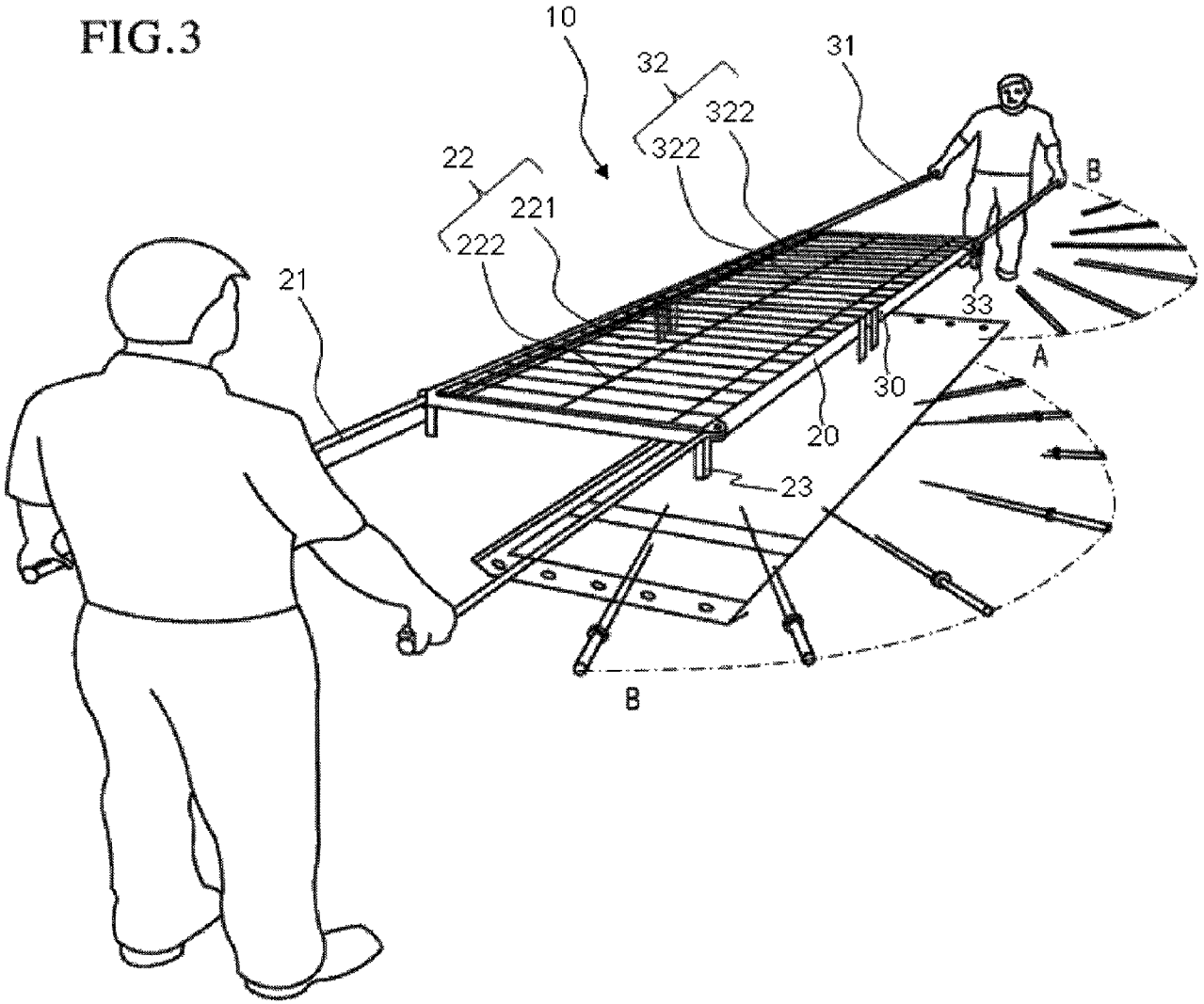

As illustrated in example FIGS. 1 to 3, in accordance with embodiments, a portable skylight change out assembly 10 is provided to permit one or more individuals to replace and/or install a skylight, vent and protective screening on and/or over a skylight in a safe manner. The skylight safety assembly 10 includes first support frame 20 which is removeably connected in an interlocking manner to second support frame 30 for placement on and/or over an opening or skylight. The support frames 20, 30 may be composed of lightweight yet structurally robust materials that can withstand an impact force of a worker. Such materials may be at least one of metal, polymer and composite materials. For example, if composed of a metal material, such material may be aluminum.

As illustrated in example FIG. 1, a bifurcated assembly 10 in accordance with embodiments may include first support frame 20 and second support frame 30 each having an array 22, 32 of support bars including a plurality of transverse frame members 221, 321 spaced apart in parallel to each other and a plurality of longitudinal frame members 222, 322 spaced apart in parallel and extending substantially perpendicularly to the transverse frame members 221, 321. The arrays 22, 32 may combine to have a planarized (i.e., flat and uniform) surface on and/or over the opening or skylight. The arrays 22, 32 may be composed of the same materials as support frame 20, 30. The arrays 22, 32 may be fixedly attached to the support frames 20, 30 are may alternatively be removeably inserted are attached at an opening in support frames 20, 30.

A plurality of support members 23, 33 extending substantially perpendicularly therefrom are provided for supporting support frame 20, 30 on and/or over an opening or skylight at a predetermined distance above the working surface. Such predetermined distance may be at least six inches. Support members 23, 33 may each include a leg member extending substantially perpendicularly from support frame 20, 30 and a foot member extending from the leg member. For example, the support member 33 includes a leg member 331 and a foot member 332 as shown in FIG. 2B. The foot member 332 actually physically contacts or otherwise abuts the working surface when support frame 20, 30 is positioned on and/or over an opening or a skylight. In accordance with embodiments, in order to maximize the resistance at an interface between the foot member 332 and the working surface, the foot member 332 includes a thin layer 333 formed at a bottommost surface thereof. The thin layer 333 is composed of a material (such as a diamond-based material) having a high coefficient of friction to provide enhanced slip resistance (i.e., maximum surface contact) when contacting the working surface.

As illustrated in example FIG. 2A and FIG. 2B, in accordance with embodiments first support frame 20 and second support frame 30 may be attached or connected to each other by locking mechanism 40 provided at a distal end of the plurality of parallel-spaced transverse members 221 and 321. Locking mechanism 40 may include a first releasable attachment mechanism 41 provided at a distal end of one of the transverse members 221 of support frame 20 and second releasable attachment mechanism 42 provided at a distal end of one of the transverse members 321 of support frame 30. First releasable attachment mechanism 41 may take the form of an extension member 411 extending substantially perpendicular to the transverse member 221. The extension member may be provided with a hook-type member 412 at a distal end thereof. Second releasable attachment mechanism 42 may take a bifurcated form that includes an extension member 421 extending substantially perpendicular from an uppermost surface of second support frame 30 and a sidewall of a distal one of the transverse members 321. Extension member 421 includes a slot 423 through which bar 422 extends substantially perpendicular therethrough. Bar 422 is sized to receive hook-type member 412 of the first releasable attachment mechanism 41. Particularly, the sidewall of the distal transverse member 321 of second support frame 30 includes a slot 424 sized to receive hook-type member 412. Slot 424 is spaced laterally from extension member 421 and enables hook-type member 421 to engage bar 422, which thereby effectuates the interlocking of the support frames 20, 30. Accordingly, first support frame 20 and second support frame 30 may be releaseably connected or attached to each other by latching the hook member 412 of first releasable attachment mechanism 41 to the bar 422 of second releasable attachment mechanism 42. The attachment may be released by merely manipulating first support member 20 upwardly relative to the working surface away from second support member 30.

As illustrated in example FIG. 3, each one of first support member 20 and second support member 30 has support handles 21, 31 provided to permit one or more persons to easily move assembly 10 from a non-working position to a working position, i.e., on and/or over an opening or skylight. Support handles 21, 31 are pivotably moveable with respect to a respective support frame 20, 30. Moreover, support handles 21, 31 laterally rotate about pivot end 211, 311 of a respective support handle along dotted line A-B of example FIG. 3. Particularly, in accordance with embodiments, each support handle 21, 31 is pivotably moveable and laterally rotates for manipulation between non-operating position "A" at a respective sidewall of support frame 20, 30 and an operating position "B" extending outwardly from support frame 20, 30 substantially along the same plane as a respective sidewall. Meaning, when manipulated into operating position "B," handles 21, 31 extend from the outer longitudinal sidewall of support frame 20, 30. Handles 21, 31 may have a length that enables one or more workers to lift assembly 10 and position the same on and/or over an opening or skylight without placing the worker at risk to fall through the opening, skylight or a weakened portion of the working surface adjacent to the opening or skylight. Handles 21, 31 may have a total length of six feet. Handles 21, 31 may also permit assembly 10 to be safely removed from the working position.

Figure 4:
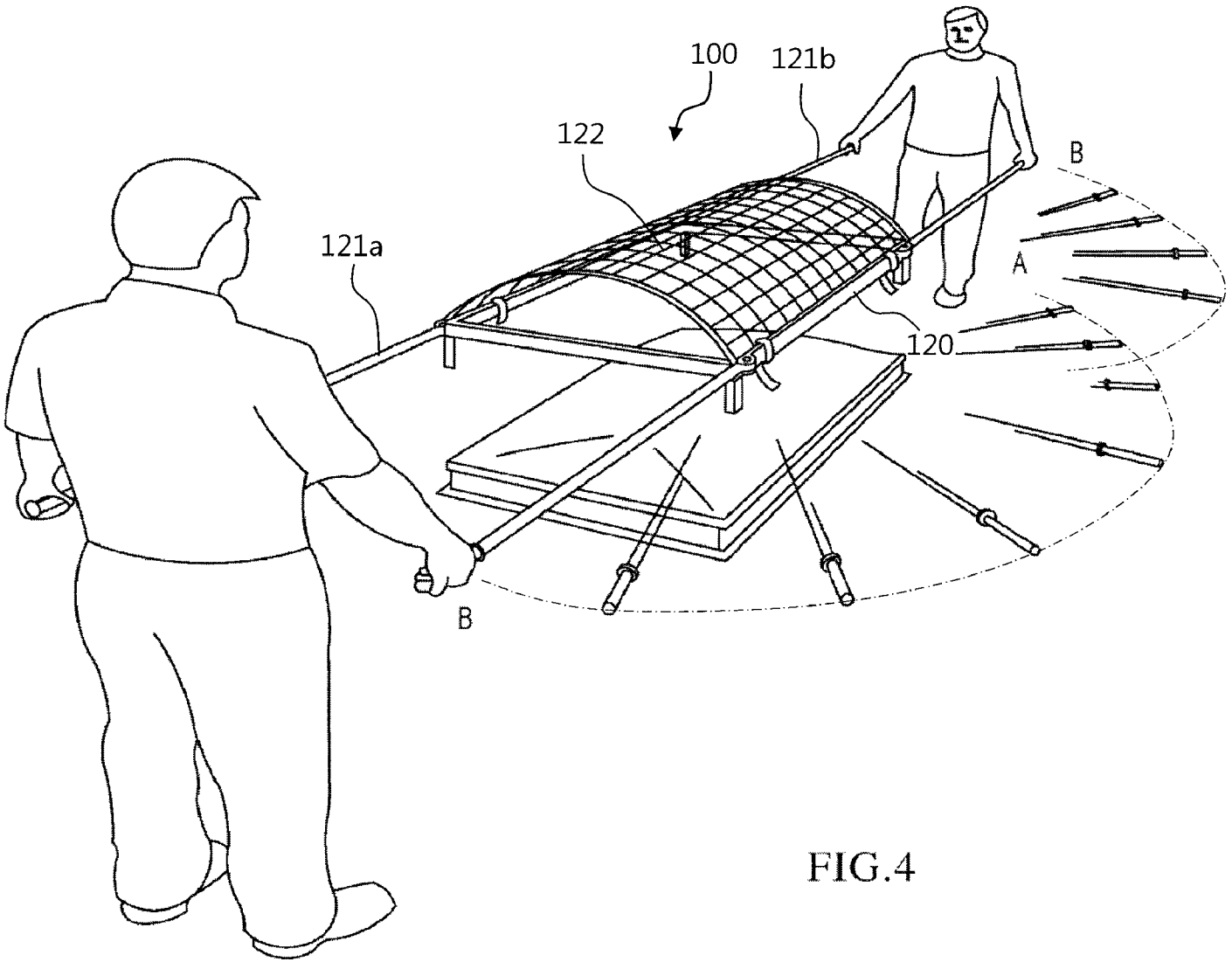
Figure 5:
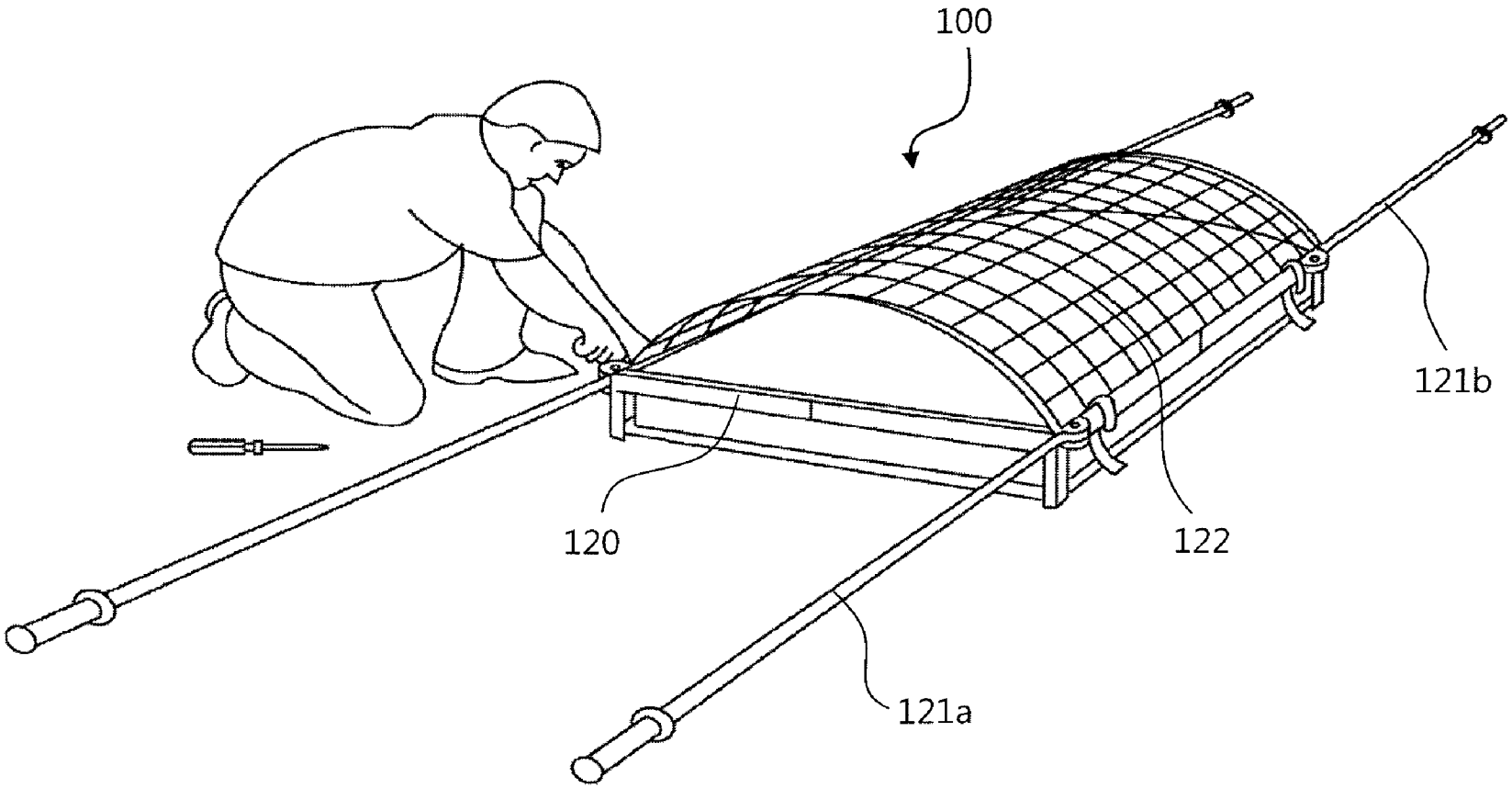

As illustrated in example FIGS. 4 and 5, assembly 100 in accordance with embodiments may have a unitary design structure including support frame 120 having an array of support bars 122 including a plurality of transverse frame members spaced apart in parallel to each other and a plurality of longitudinal frame members spaced apart in parallel and extending substantially perpendicularly to the transverse frame members. Support bars 122 may come in the form of a screen mesh or grid. Support bars 122 may combine to have an arcuate (semi-spherical) surface on and/or over the opening or skylight. Support bars 122 may be composed of the same materials as support frame 120, i.e., at least one of metal, polymer and composite materials.

As illustrated in example FIG. 4, support member 120 has support handles 121 on distal ends thereof for facilitating one or more persons to easily and quickly move assembly 10 from a non-working position to a working position, i.e., on and/or over an opening or skylight. Support handles 121 are pivotably moveable with respect to a respective support frame 120. For instance, support handles 121 are pivotably moveable for manipulation between non-operating position "A" at a respective sidewall of support frame 120 and an operating position "B" extending outwardly from support frame 120 substantially along the same plane as a respective sidewall. When manipulated into operating position "B," handles 121 extend from the outer longitudinal sidewall of support frame 120. Handles 21, 31 may have a length that enables one or more workers to safely lift assembly 10 and position the same on and/or over an opening or skylight without placing the worker at risk to fall through the opening, skylight or a weakened portion of the working surface adjacent to the opening or skylight. Handles 121 may have a total length of six feet. Handles 121 may also permit assembly 100 to be safely removed from the working position.

Accordingly, in accordance with embodiments, a portable skylight change out assembly is provided having a bifurcated or unitary design that offers protection against falls over skylights, skylight openings, floor openings, vent openings and other types of roof openings. The portable skylight change out assembly is composed of lightweight materials, and thus, is easily transportable by one or more persons. Due to its lightweight, the assembly does not impose undue loads on and/or an opening or skylight that would place a worker at risk when installing, replacing or repairing a roof skylight. A pair of support handles are provided at distal ends of the assembly to permit one or more workers to safely transport and position the assembly on and/or over skylights, skylight openings, floor openings, vent openings and other types of roof openings.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art

What is claimed is:

1. A portable skylight safety assembly comprising:

a first support base having a plurality of first sidewalls and a first support array positioned interior to the first sidewalls and which form a first support surface that includes a plurality of first parallel-spaced transversely extending members and a plurality of first parallel-spaced longitudinally extending base members which extend substantially perpendicularly to the plurality of first parallel-spaced transversely extending members;

a first releasable attachment mechanism provided on a distal one of the plurality of first parallel-spaced transverse members, said first releasable attachment mechanism comprising a first extension member extending substantially perpendicular to the distal one of the plurality of first parallel-spaced transverse members and a hook member extending colinearly from the first extension member;

a second support base having a plurality of second sidewalls and a second support array positioned interior to the second sidewalls and which form a second support surface coplanar to the first support surface and that includes a plurality of second parallel-spaced transversely extending members and a plurality of second parallel-spaced longitudinally extending base members which extend substantially perpendicularly to the plurality of second parallel-spaced transversely extending members, wherein a distal one of the second parallel-spaced transversely extending base members includes a first slot sized to receive the hook-type member when the first support base and the second support base are placed in a releasably connected position; and a second releasable attachment mechanism provided on a distal one of the plurality of second parallel-spaced transverse members, said second releasable attachment mechanism comprising a second extension member extending substantially perpendicular to the distal one of the plurality of second parallel-spaced transverse members and having a second slot, and a bar extending through the second slot perpendicularly to the second extension member, wherein the bar is received by and interlockingly engages the hook member to releasably connect the first support base to the second support base.

2. The portable skylight safety assembly of claim 1, further comprising:

a pair of first support handles having a pivot end pivotably connected to the first support base such that each of the first support handles rotate laterally on the pivot end thereof between a non-operation position and an operation position.

3. The portable skylight safety assembly of claim 1, further comprising:

a pair of second support handles having a pivot end pivotably connected to the second support base such that each of the second support handles rotate laterally on the pivot end thereof between a non-operation position and an operation position.

4. The portable skylight safety assembly of claim 1, further comprising:

a pair of first support handles having a first pivot end pivotably connected to the first support base such that each of the first support handles rotate laterally on the first pivot end thereof between a non-operation position and an operation position; and a pair of second support handles having a second pivot end pivotably connected to the second support base such that each of the second support handles rotate laterally on the second pivot end thereof between a non-operation position and an operation position.

5. The portable skylight safety assembly of claim 1, further comprising:

first support members extending substantially perpendicularly from the first support base to support the first support base on a working surface.

6. The portable skylight safety assembly of claim 1, further comprising:

second support members extending substantially perpendicularly from the second support base to support the second support base on a working surface.

7. The portable skylight safety assembly of claim 1, further comprising:

first support members extending substantially perpendicularly from the first support base to support the first support base on a working surface; and second support members extending substantially perpendicularly from the second support base to support the second support base on a working surface.

8. A portable skylight safety assembly provided to permit at least one of a replacement and installation of a skylight, vent and protective screening over a skylight, said portable skylight safety assembly comprising:

a first support base having a pair of spaced apart first lateral sidewalls and a first front sidewall extending between the first lateral sidewalls, and a plurality of first support bars extending between the first front sidewall and the first lateral sidewalls to define a first support surface, wherein the first support base and the first support surface are each composed of a metal material;

a second support base having a pair of spaced apart second lateral sidewalls and a second front sidewall extending between the second lateral sidewalls, and a plurality of second support bars extending between the second front sidewall and the second lateral sidewalls to define a second support surface that is coplanar to the first support surface, wherein the second support base and the second support surface are each composed of a metal material;

a locking mechanism for releasably connect the first support base to the second support base, the locking mechanism including a first releasable attachment mechanism provided on the first support base and comprising a first extension member extending from a distal end of the first support base and a hook member extending colinearly from the first extension member, and a second releasable attachment mechanism provided on the second support base and comprising a second extension member extending from a distal end of the second support base, and a bar extending through the second extension member which interlockingly engages the hook member to releasably connect the first support base to the second support base;

first support handles having a first pivot end pivotably connected to the first support base such that each of the first support handles rotate laterally on the first pivot end thereof between a non-operation position on the first lateral sidewalls of the first support base, respectively and an operation position extending outwardly from the first support base substantially along the same plane as a respective one of the first lateral sidewalls; and second support handles having a second pivot end pivotably connected to the second support base such that each of the second support handles rotate laterally on the second pivot end thereof between a non-operation position on the second lateral sidewalls of the second support base and an operation position extending outwardly from the second support base substantially along the same plane as a respective one of the second lateral sidewalls, wherein the first and second support handles each have a length of 6 feet.

9. The portable skylight safety assembly of claim 8, further comprising:

first support members extending substantially perpendicularly from the first support base to support the first support base on a working surface; and second support members extending substantially perpendicularly from the second support base to support the second support base on a working surface.

10. The portable skylight safety assembly of claim 9, wherein:

the first support members comprise a first leg member extending substantially perpendicularly from the first support base and a first foot member extending from the first leg member which contacts the working surface when the first support base is positioned on the working surface; and the second support members comprise a second leg member extending substantially perpendicularly from the second support base and a second foot member extending from the second leg member which contacts the working surface when the second support base is positioned on the working surface.

11. The portable skylight safety assembly of claim 10, wherein the first and second foot members each include at a bottommost surface thereof a separate support layer material having a high coefficient of friction which engages the working surface.

12. The portable skylight safety assembly of claim 8, wherein the metal material comprises aluminum.

13. A portable skylight safety assembly provided to permit at least one of a replacement and installation of a skylight, vent and protective screening over a skylight, said portable skylight safety assembly comprising:

a first support base having a first support surface and a first releasable attachment mechanism provided thereon, the first releasable attachment mechanism comprising a first extension member extending from a distal end of the first support base and a hook member extending colinearly from the first extension member;

a second support base having a second support surface that is coplanar to the first support surface and a second releasable attachment mechanism provided thereon, the second releasable attachment mechanism comprising a second extension member extending from a distal end of the second support base and having a slot, and a bar extending through the slot perpendicularly to the second extension member and which interlockingly engages the hook member to releasably connect the first support base to the second support base;

first support handles each being six feet in length and pivotably connected to the first support base to permit movement between a non-operation position on respective sidewalls of the first support base and an operation position extending outwardly from the first support base substantially along the same plane as respective sidewalls of the first support base; and second support handles each being six feet in length and pivotably connected to the second support base to permit movement between a non-operation position on respective sidewalls of the second support base and an operation position extending outwardly from the second support base substantially along the same plane as respective sidewalls of the second support base.

* * * * *